United States Patent [19]

Kildea

[11] Patent Number: 4,738,587

[45] Date of Patent: Apr. 19, 1988

[54] COOLED HIGHLY TWISTED AIRFOIL FOR A GAS TURBINE ENGINE

[75] Inventor: Robert J. Kildea, N. Palm Beach, Fla.

[73] Assignee: United Technologies Corporation, Hartford, Conn.

[21] Appl. No.: 945,107

[22] Filed: Dec. 22, 1986

[51] Int. Cl.[4] ..... B63H 1/14

[52] U.S. Cl. ..... 416/96 R; 416/97 R

[58] Field of Search ..... 416/96 R, 96 A, 97 R, 416/97 A; 29/156.8 R, 156.8 H; 164/34, 35, 122.1, 122.2, 516

[56] References Cited

U.S. PATENT DOCUMENTS

| | | | |
|---|---|---|---|
| 3,171,631 | 3/1965 | Aspinwall | 416/90 R |
| 3,533,712 | 10/1970 | Kercher | 416/92 |
| 4,063,851 | 12/1977 | Weldon | 416/97 A |
| 4,073,599 | 2/1978 | Allen et al. | 416/97 R |
| 4,177,010 | 12/1979 | Greaves et al. | 416/97 R |
| 4,180,373 | 12/1979 | Moore et al. | 416/97 R |
| 4,224,011 | 9/1980 | Dodd et al. | 416/97 R |
| 4,278,400 | 7/1981 | Yamarik et al. | 416/97 R |
| 4,421,153 | 12/1983 | Wilkinson et al. | 164/34 |
| 4,627,480 | 12/1986 | Lee | 164/122.1 |

FOREIGN PATENT DOCUMENTS

| | | | |
|---|---|---|---|
| 2569225 | 6/1978 | France | 164/34 |
| 0170801 | 10/1983 | Japan | 416/97 R |
| 0003403 | 1/1985 | Japan | 416/97 R |

*Primary Examiner*—Robert E. Garrett
*Assistant Examiner*—Therese M. Newholm
*Attorney, Agent, or Firm*—William J. Sapone

[57] ABSTRACT

A cooled highly twisted airfoil (1) includes an integrally formed continuous warped wall (12) defined as a surface of revolution about an axis (13) with the axis determined such that the axis intersects the plane of a section along a desired centerline. Such an internal wall structure separates adjacent cooling cavities (10) and (11) and includes relatively precisely aligned impingement holes (14) for directing cooling air to the leading edge (6) of a highly twisted airfoil. Such a structure minimizes the complexity of the ceramic core and die inserts required to cast such an airfoil, thereby decreasing manufacturing costs while increasing the overall cooling efficiency of the blade.

3 Claims, 4 Drawing Sheets

COOLED HIGHLY TWISTED AIRFOIL FOR A GAS TURBINE ENGINE

DESCRIPTION

The Government has rights in this invention pursuant to Contract No. DAAK51-83-C-0015 awarded by the Department of the Army.

TECHNICAL FIELD

This invention relates to cooled highly twisted airfoils used in high temperature gas turbine engines and more specifically to an airfoil which incorporates a structure for internally cooling the leading edge of a highly twisted airfoil.

BACKGROUND ART

An axial gas turbine engine includes a compressor section, a combustion section, and a turbine section. Disposed within the turbine section are alternating rows of rotatable airfoil blades and static vanes. As hot combustion gases pass through the turbine section, the airfoil blades are rotatably driven, turning a shaft and thereby providing shaft work for driving the compressor section and other auxiliary systems. The higher the gas temperature, the more work that can be extracted in the turbine section. During operation, the airfoils are constantly in contact with the hot working gases causing thermal stresses in the airfoils which effect the structural integrity and fatigue life of the airfoil. In an effort to increase the turbine section operating temperature, nickel or cobalt base superalloy materials are used to produce the turbine airfoil blades and vanes. Such materials maintain mechanical strength at high temperatures. However, even using such materials, it is necessary that the airfoil blades and vanes be cooled to maintain the structural integrity and fatigue life of the airfoil.

Numerous attempts have been made to provide internal cooling in airfoil structures. For example, in U.S. Pat. No. 3,171,631, issued to Aspinwall, titled "Turbine Blade", cooling air is flowed to a cavity between the suction sidewall and the pressure sidewall of an airfoil and diverted to various locations in the cavity by the use of turning pedestals or vanes. Another example is found in U.S. Pat. No. 3,533,712, to Kercher, titled "Cooled Vane Structure or High Temperature Turbines", where the use of serpentine passages extending throughout the cavity in the blade provides cooling to different portions of the airfoil. In U.S. Pat. No. 4,073,599, issued to Allen et al., titled "Hollow Turbine Blade Tip Closure", intricate cooling passages are coupled with other techniques to cool the airfoil. For example, the leading edge region in Allen et al. is cooled by impingement cooling followed by the discharge of the cooling air through a spanwise extending passage in the leading edge region of the blade.

In particular, small radius, high rotor speed engines require turbine blades which have highly twisted airfoils with a large variation of leading edge angle. A highly twisted airfoil has a high ratio of tip radius to root radius which provides a large change in airflow turning angle (camber) from root to tip, particularly in the leading edge area. While such a highly twisted leading edge has aerodynamic advantages, such a structure imposes severe restrictions on the design of the internal cooling structures required to obtain optimum leading edge cooling. In order to optimally cool the leading edge of such a blade, impingement holes must be incorporated internally which follow relatively precisely the leading edge angle. Most attempts to incorporate such impingement holes have been unsuccessful due to the difficulty in forming core dies which can accurately and consistently produce cores having the proper twist. Consequently, a need has arisen to provide a cooled, highly twisted airfoil which includes a structure for optimally cooling the leading edge region of the airfoil while minimizing processing time and reducing costs.

DISCLOSURE OF INVENTION

According to the present invention, a cooled, highly twisted airfoil includes an integrally formed, continuous warped wall which is defined as a surface of revolution about an axis, with the axis chosen such that at each defined section of the airfoil, the axis intersects the plane of a defining section along or close to the desired centerline of the required feed impingement holes. A particular advantage of having such a structure is the minimization of core die inserts required to cast such a turbine airfoil. Previous attempts to incorporate such a feature in an airfoil blade required six inserts for the core die to provide a three step approximation to the desired wall. The inventive warped wall structure, defined as a surface of revolution about the axis, is provided by utilizing a core die for the two leading edge cavities which has a hinge line coincident with the axis and a parting line normal thereto in alignment with the impingement holes.

BEST MODE FOR CARRYING OUT THE INVENTION

Figure 1:
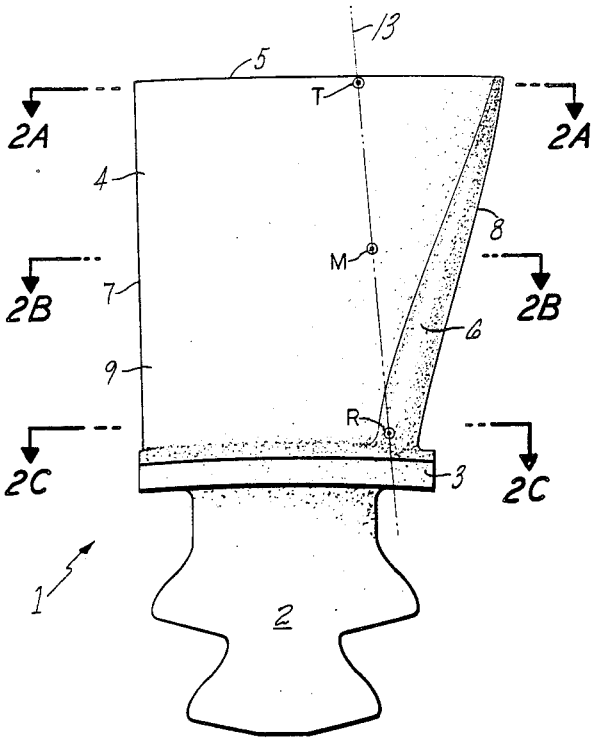
FIG. 1 is a view of a highly twisted airfoil.

Referring to FIG. 1, an airfoil 1 for a gas turbine engine is shown having an attachment section 2, a platform section 3 and a blade section 4. The attachment section is adapted to engage the rotor of a gas turbine engine. The platform section is adapted to form a portion of the inner wall of the flow path for the working medium gases in the gas turbine engine. The blade section 4 is adapted to extend outwardly across the flow path for the working medium gases and has a tip 5 at its outward end, a leading edge 6 and a trailing edge 7. A suction sidewall 8 and a pressure sidewall 9 are joined at the leading and trailing edges, with the blade having a large leading edge angle.

Figure 2A:
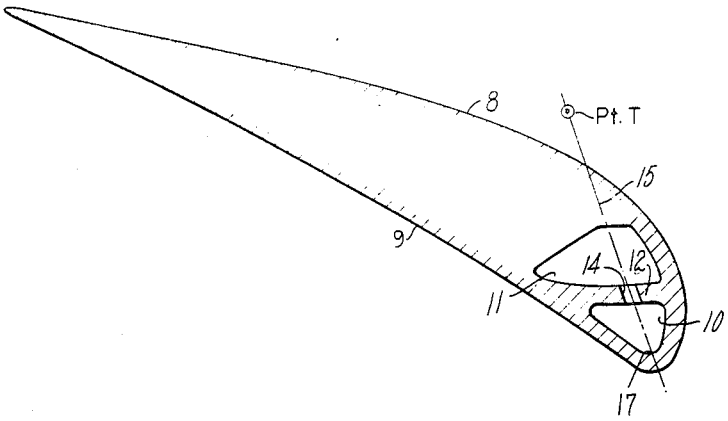
FIG. 2A is a cross-sectional view taken along the lines 2A—2A of FIG. 1.
Figure 2B:
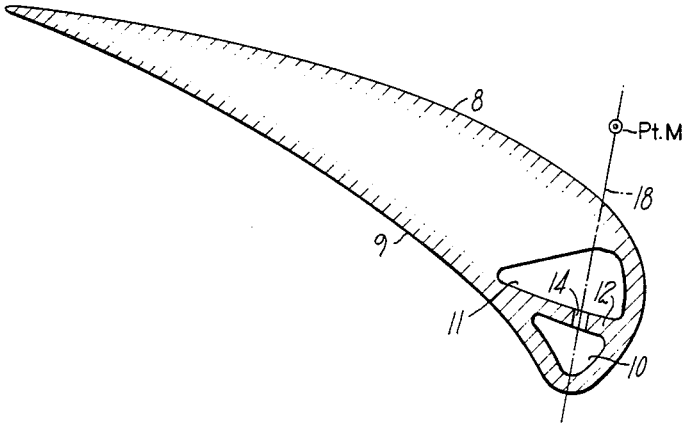
FIG. 2B is a cross-sectional view taken along line 2B—2B of FIG. 1.
Figure 2C:
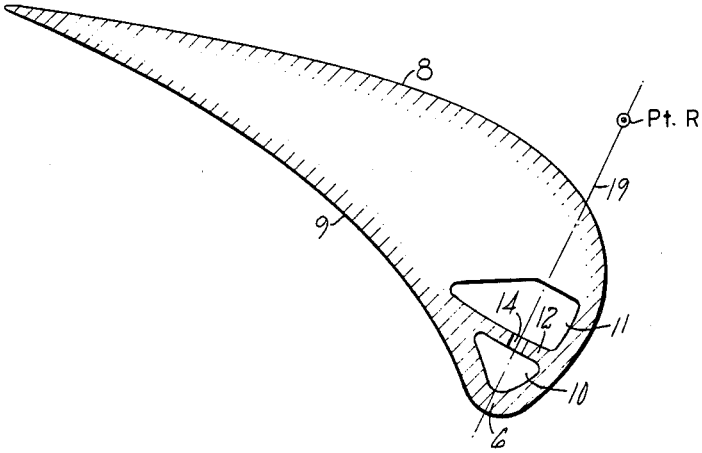
FIG. 2C is a cross-sectional view taken along line 2C—2C of FIG. 1.

Referring to FIGS. 2A, 2B and 2C, three cross-sectional slices are shown taken along the lines 2A—2A, 2B—2B and 2C—2C of FIG. 1, respectively. A leading edge cooling cavity 10 and an adjacent cooling cavity 11 are shown for each section separated by a warped wall 12. Referring to FIG. 1, an axis 13 is shown which is used for determining the surface of revolution of the warped wall 12 as well as for determining the hinge line on a core die which is used to produce ceramic cores for incorporation in an investment casting mold. The axis 13 is in essential alignment with the impingement cooling holes 14, shown in FIG. 2, which follow the leading edge 6 of the airfoil 1. To determine the orientation of the axis, at least two lines are drawn perpendicular to the desired wall, passing through the leading edge at the point of optimum cooling and the approximate mid-section of the warped wall 12. Generally, for increased accuracy, a series of such lines will be drawn from tip to root, and a line in space chosen which comes closest to intersecting these lines. This line in space is the desired axis of revolution for the wall between the cooling cavities 10 and 11. Of course, with a curved blade it will be impossible to precisely provide an axis which intersects each cooling hole precisely. Under such circumstances, a "best fit" approach is used, guided by the particular features of a blade. For example, the tip may experience higher operating temperatures than the root, therefore, it would be advantageous to more closely follow the optimum trace through the tip section than the root section. Of course, the final centerline of the cooling holes should be adjusted vertically to make them perpendicular to the wall.

For illustrative purposes, points T, M, and R are shown in FIGS. 2A, 2B and 2C, respectively, which define the traces of the axis of the warped wall at the tip, mean and root sections, respectively. Points T, M and R are arbitrarily chosen at a sufficient distance from the blade wall to provide space for the core die wall to be formed. Of course, the thickness of the core die wall will vary from application to application depending on various design criteria. In FIG. 2A, a line 15 is drawn through an impingement hole 14 and a desired point 17 where optimum cooling on the leading edge is obtained. Similarly, in FIGS. 2B and 2C, lines 18 and 19 are drawn. After determining these three points, a line is drawn therethrough, as illustrated in FIG. 1 by the axis 13, which is the preferred hinge line location. While the preferred location of an impingement cooling hole should be at the mid-section of the warped wall, this may not be possible in all situations, requiring some compromise to achieve a straight axis. The preferred location for the leading edge impingement holes 14 will then generally be in a line normal to the leading edge, from tip to root, and consequently be approximately parallel to the axis 13.

Figure 4:
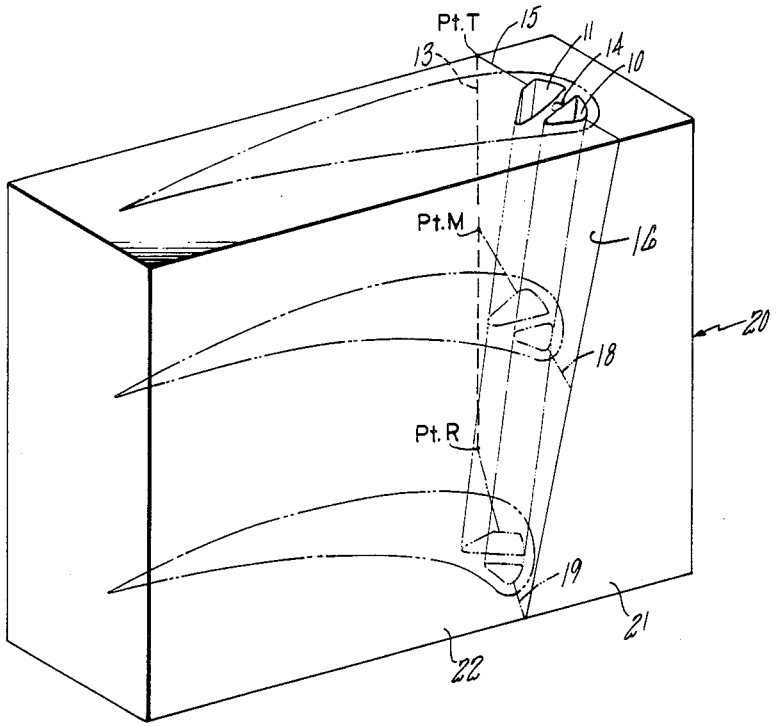
FIG. 4 is an illustrative view of a core die having a hinge line coincident with the axis 13.

For illustrative purposes, a single core die 20, shown in FIG. 4 will be discussed for making a core required for integrally forming the warped wall 12 in an airfoil. While such a single die is discussed for producing a core, it will be understood by those skilled in the art that other core dies can be designed to take advantage of the method herein described, including those utilizing die inserts to form the proper shape of cooling air cavity (in that instance the inserts would be rotatable out of the die, rotating about the axis 13 on withdrawal). For illustrative purposes, the single core die 20 has two opposing halves 21 and 22 which are rotatable into contact. Each half includes a recessed portion which, when the halves are in engagement, combine to form a hollow core shape.

To provide the inventive warped wall in a highly twisted airfoil, the core die must incorporate a hinge line which is coincident with the axis 13. This hinge line, following approximately the camber of the airfoil is, therefore, parallel to the desired impingement holes. The parting surface 16, illustrated segmentally in FIG. 3, and as a plane in FIG. 4 defines the mating boundary between the opposing core die halves, and is essentially a surface which contains the centerlines 15, 18 and 19 of the impingement holes 14. This allows separation of the core die halves along the plane of the impingement holes for ease of removal of the molded cores without damaging the hole structures. This also eliminates the requirement for multiple core dies and multiple cores in the production of a single airfoil, significantly reducing manufacturing costs while also reducing the potential for misalignment of the core sections and improperly cast airfoils.

Figure 3:
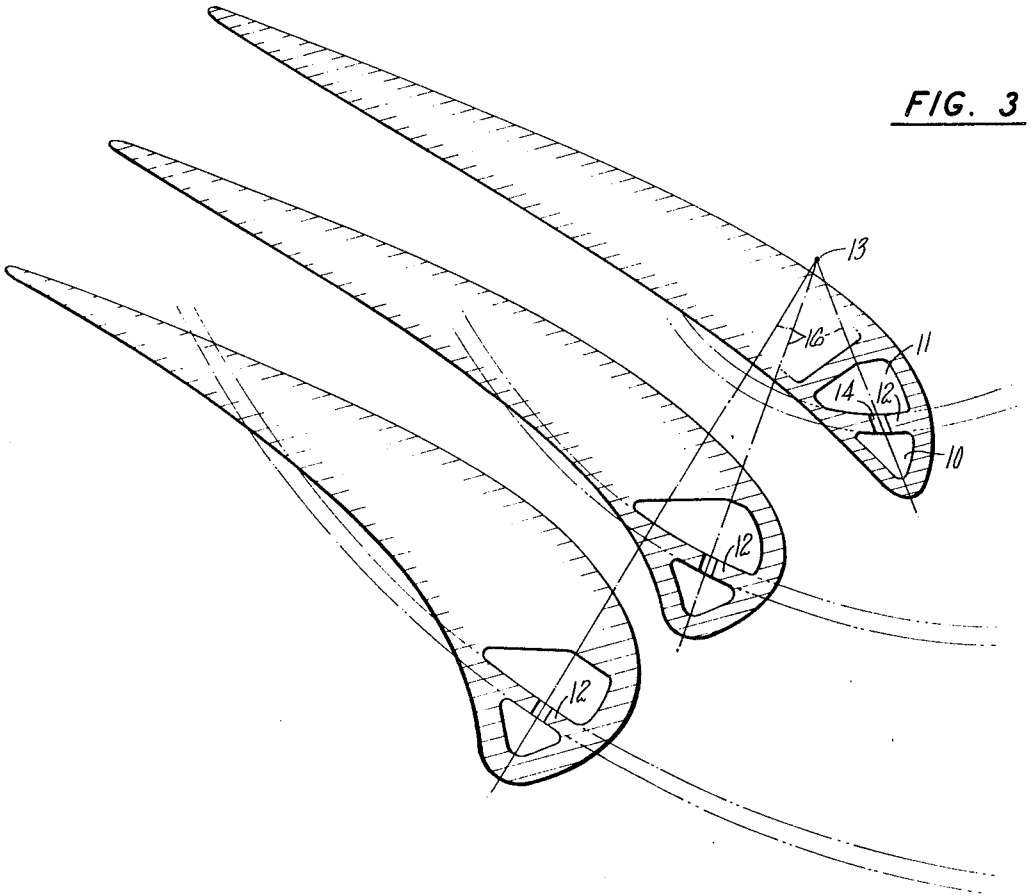
FIG. 3 is a view looking along the axis 13 drawn through points T, M and R of FIG. 1. Three typical airfoil sections are shown near the airfoil tip, mean and root sections, with each section cut by a plane normal to the axis through the points T, M and R.

FIG. 3 shows a view of the root, mean and tip sections showing development of the warped airfoil wall as a surface of revolution about the axis 13. This view is taken looking at the axis in an end view, with the sections taken perpendicular to the axis, illustrating the parting surface 16 as it passes from tip to root. From FIG. 3, it is evident that the leading edge is highly twisted from tip to root requiring a complex structure for providing leading edge cooling internally. It is also evident that the warped wall, while varying in direction from tip to root, still is defined as a surface of revolution about the axis, allowing rotatable disengagement from the core die.

By defining the inventive warped wall as a surface of revolution about an axis and then using the axis to define the hinge line of the core die, the dies halves are movable away from the core following the arc of the warped wall and are withdrawn without scraping the fragile core. Of course, a certain degree of draft may be incorporated within the die halves, such draft involving a taper in the core die in the direction of removal. For the inventive warped wall this will produce a relatively thinner wall in the center at the parting line of the die, and outward thickening to the juncture of the warped wall with the pressure and suction sidewalls.

After the core die is produced, a ceramic core molding compound is inserted into the die, forming the desired shape. The halves are then rotated in an arc away from each other, thereby freeing the molded core. This core is then debindered, sintered and incorporated in a wax pattern following general practice in the investment casting industry. A shell is then applied, forming a complete mold of the airfoil. The mold is then fired to displace the wax and molten metal added to form the airfoil. After cooling, the ceramic core is leached or otherwise removed, thereby providing a highly twisted airfoil having an integrally formed warped wall which includes a line of impingement holes in alignment with the leading edge.

Although the invention has been shown and described with respect to preferred embodiments thereof, it should be understood by those skilled in the art that various changes and omissions in the form and detail thereof may be made without varying from the scope of the invention.

Having thus described the invention, what is claimed is:

1. A cooled highly twisted airfoil for use in a gas turbine engine, said airfoil having a first cooling air cavity adjacent a leading edge of said airfoil, and a second cooling air cavity, separated from the first cavity by a wall, said second cavity providing cooling air to the first cavity by means of a plurality of cooling holes provided in said wall, the improvement characterized by:

said wall comprising an integrally formed, continuous warped wall, defined as a surface of revolution about an axis, said axis determined such that the axis intersects the plane of a section close to a desired centerline of a series of impingement holes aligned in opposition to the leading edge, whereby cooling air is directed relatively precisely to the leading edge of the highly twisted airfoil through said impingement holes.

2. A method for producing cooled highly twisted turbine airfoils, said method including the steps of preparing a core molding compound, molding the compound into a desired core shape using a core die, debindering said core shape, sintering said core shape, forming a solid core body, incorporating said core body into a wax pattern, displacing the wax with molten metal, cooling the metal structure formed and removing the core to provide voids in the airfoil structure, wherein the improvement is characterized by:

providing a core die comprising two die halves rotatable into engagement, each die half including a recess, said recesses forming a core-shaped chamber when said die halves are in engagement, said core die having a hinge line coincident with an axis that intersects the plane of a section close to a desired centerline of a series of impingement holes aligned in opposition to a leading edge of said airfoil, said core die including a parting surface normal to the hinge line, said parting surface defining a mating boundary when the opposing die halves are in engagement, said parting surface passing essentially through the centerline of said impingement holes.

3. A cooled highly twisted airfoil produced in accordance with the method of claim 2.

* * * * *